US007673767B2

(12) United States Patent
Vovan

(10) Patent No.: US 7,673,767 B2
(45) Date of Patent: Mar. 9, 2010

(54) INTERCONNECTING FOOD CONTAINER SYSTEM

(75) Inventor: Terry Vovan, Rialto, CA (US)

(73) Assignee: PWP Industries, Vernon, CA (US)

( * ) Notice: Subject to any disclaimer, the term of this patent is extended or adjusted under 35 U.S.C. 154(b) by 368 days.

(21) Appl. No.: 11/542,985

(22) Filed: Oct. 3, 2006

(65) Prior Publication Data

US 2008/0078686 A1 Apr. 3, 2008

(51) Int. Cl.
*B65D 41/56* (2006.01)

(52) U.S. Cl. ..... 220/212; 220/379; 220/744

(58) Field of Classification Search ..... 220/501, 220/212, 744, 713, 379, 751; 206/501
See application file for complete search history.

(56) References Cited

U.S. PATENT DOCUMENTS

| | | | | | |
|---|---|---|---|---|---|
| 314,244 | A * | 3/1885 | Henkel | 220/832 |
| 434,844 | A * | 8/1890 | Stone | 220/379 |
| 1,390,766 | A * | 9/1921 | Cunningham | 220/744 |
| 1,517,089 | A * | 11/1924 | Moore | 220/278 |
| 1,745,548 | A * | 2/1930 | Lerner | 248/229.26 |
| 1,778,175 | A * | 10/1930 | Thune | 47/71 |
| 2,259,770 | A * | 10/1941 | Nove | 220/379 |
| 2,957,596 | A * | 10/1960 | Rehborg | 215/386 |
| 3,015,405 | A * | 1/1962 | Sterling | 217/56 |
| 3,163,385 | A * | 12/1964 | Lazan, Jr. | 248/37.6 |
| 3,390,804 | A * | 7/1968 | Morgan | 220/212 |
| 4,054,205 | A * | 10/1977 | Blow et al. | 206/217 |
| 4,592,483 | A * | 6/1986 | Scouten | 220/379 |
| 4,854,466 | A * | 8/1989 | Lane, Jr. | 220/23.83 |
| 5,092,480 | A * | 3/1992 | Waterston | 220/23.4 |
| 5,148,937 | A * | 9/1992 | Huard | 220/278 |
| 5,287,979 | A * | 2/1994 | Bourgeois | 220/4.21 |
| 5,590,804 | A * | 1/1997 | Crum et al. | 220/483 |
| 5,683,010 | A * | 11/1997 | Boyajian, Jr. | 220/744 |
| 6,131,755 | A * | 10/2000 | Soyka et al. | 215/390 |
| 6,338,417 | B1 * | 1/2002 | Ferraro | 220/23.83 |
| 6,394,297 | B1 * | 5/2002 | Nance | 220/23.4 |
| 6,571,975 | B1 * | 6/2003 | Fay | 220/379 |
| 6,706,297 | B1 * | 3/2004 | Toth et al. | 426/120 |
| 7,025,312 | B1 * | 4/2006 | Dare | 248/176.1 |
| 7,175,043 | B2 * | 2/2007 | O'Neal | 220/379 |
| 2005/0173434 | A1 * | 8/2005 | O'Neal | 220/212 |
| 2007/0051738 | A1 * | 3/2007 | Slayton | 220/780 |

* cited by examiner

*Primary Examiner*—Anthony Stashick
*Assistant Examiner*—Christopher B McKinley
(74) *Attorney, Agent, or Firm*—Leon D. Rosen

(57) ABSTRACT

The claimed invention is a novel container system that adds utility and convenience for the consumer "on-the-go". The container system claimed includes a main tray member that holds food product (e.g. carrots), and lid member that is configured so that, when it is inverted, it acts as a secondary tray member that holds food product (e.g. condiment) and is further attachable to the rim of the tray member via an interference fit or snap-fit grip fit. The resulting utility is that the consumer is able to hold the main tray member with one hand or have held the main tray member (e.g. in a recess in an automobile consol) and access the contents of both trays with a free hand.

4 Claims, 21 Drawing Sheets

INTERCONNECTING FOOD CONTAINER SYSTEM

FIELD OF THE INVENTION

The present invention relates to a rigid food container system configuration for foodstuff that preserves and facilitates the displaying of contents. More particularly, the invention relates to a food packaging containment system where a first food container and a second food container are held together by snap-fit.

BACKGROUND OF THE INVENTION

Restaurants and food markets have utilized rigid containers to protect and display both perishable and fragile food items such as sandwiches, salads and bakery items. Rigid plastic food containers are typically manufactured from Polystyrene, Polypropylene, Polyethylene Terephthalate (PET), Polylactide, Polyvinyl Chloride (PVC), or other rigid polymers. They generally comprise either of two-parts—a tray and lid—or they may be a one-piece construction with a hinge that modifies one portion of the container to act as the tray and the other connected portion to act as a lid. Furthermore, they are available in a variety of shapes and cross-sections—circular, rectangular, square, and elliptical, etc.

These traditional roles of plastic packaging are now the minimum expected standards, and the requirements placed on plastic food packaging continue to expand as increasing demands are placed upon it. Presentation, brand presence, consumer desires, added value to enhance commercial competitiveness, differentiation, imagery and psychology has resulted in the design and application of plastic packaging becoming more challenging. Convenience and versatility continue to shape the future of packaging, with consumers gravitating toward packaged convenience items that minimize the impact on their behavior. This has forced packaging manufacturers to include social and environmental considerations into their development process. The growth of fast food restaurants and the competitive response from food markets offering packaged meal product for consumers "on-the-go" is such an indication of this trend. However, there is a growing body of evidence that consuming fast food product while driving presents enormous hazards. Despite regulation that requires at least one hand on the wheel at all times, much of currently available food product and its packaging is not designed with this regulation in mind. It is difficult, if not impossible, for example, for one to safely consume a food product that may need a condiment or other taste-enhancing feature. Additionally, this form of food consuming has gained more attention since the banning in some areas on handheld cell phones—representing a belief that multi-tasking when driving is hazardous.

Despite these concerns, this trend is unlikely to stop as consumers lifestyles evolve. The fast food industry is growing and the automotive industry continues to provide in-vehicle accessories and interiors to promote eating and drinking. All this presents opportunities to packaging manufacturers and their food processing clients to develop packaging integrated food solutions especially for convenience-oriented consumers while in transport.

There is a need to offer a variety of convenience-enhancing multiple compartmentalized food trays that take into account driver ergonomics, including the encumbrance consuming food while driving places on the driver and passengers, and existing accessories that currently exist in vehicles. This invention provides for a unique approach that achieves this objective.

SUMMARY OF THE INVENTION

In a preferred embodiment of the invention, the food container system comprises a first tray member and at least one smaller tray member, wherein the smaller tray member is formed with a shaped channel into its underside so that the rim of the first tray may be inserted into the shaped channel. The first tray member acts as the primary supporting means for the smaller second tray member so that a complementary combination of food items may be associated more effectively and will further be efficiently handed from one person to another. For example, the first tray member may contain corn chips or vegetables and a smaller second tray may contain a complementary condiment thereby providing enhanced utility to consumers. Ideally, the weight distribution between the first and the at least one smaller tray member is such that when they are integrated together by inserting the rim of the first tray member into the shaped channel of the smaller second tray member, the integrated food container system is able to stand alone and be held up by the base first tray.

In another embodiment of the invention, the food container system comprises a first tray member and a lid member, that when in its typical market display mode, the food container system stands upright with the base of the first tray member supported on, say, a shelf and the mouth of the lid member is attached to the mouth of the tray member in order to protect its contents using a detachable interlocking arrangement. The detachable interlocking arrangement may be a releaseably lockable snap-fit lock mechanism that ensures that the lid member and the tray member are held firmly together as the food container system is transported. Further, the lid member is formed firstly with a raised roof such that when the said lid member is inverted, it acts as a second smaller tray that can be used to hold additional foodstuff, and secondly with a shaped channel into which the rim of the first tray may be inserted. As in with the prior embodiment, the weight distribution between the first and second tray members are such that the integrated food container system is held up by the base tray when placed on a supporting surface, such as a table. Alternatively, the first tray member may be formed so that it can be held by the consumer with one hand, thereby leaving the consumer's other hand to access the food items in both tray members.

This invention is a novel plastic packaging solution that improves significantly on the convenience and therefore marketability of food product.

Further areas of applicability of the present invention will become apparent from the detailed description provided hereinafter. It should be understood that the detailed description and specific examples are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The present invention will now be described more fully hereinafter with reference to the accompanying drawings, in which preferred embodiments of the invention is described. This invention may, however, be embodied in many different forms and should not be construed as limited to the embodiments set forth herein; rather, the embodiments are provided so that this disclosure will be thorough and complete and will fully convey the scope of the invention to those skilled in the art.

Figure 1:
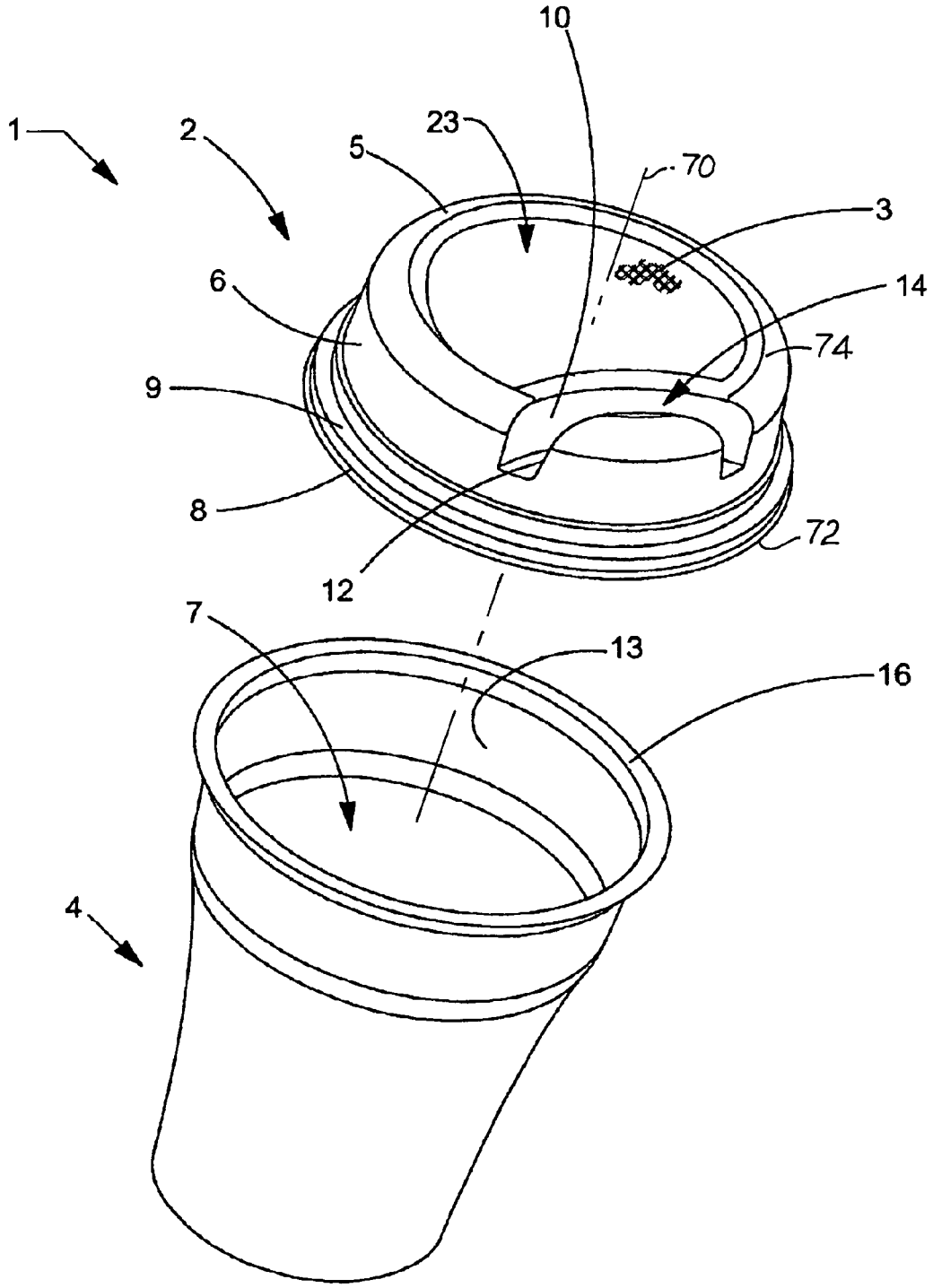
FIG. 1 is an isometric view of an embodiment of the present invention showing the disassembled smaller second tray member and first tray member.
Figure 2:
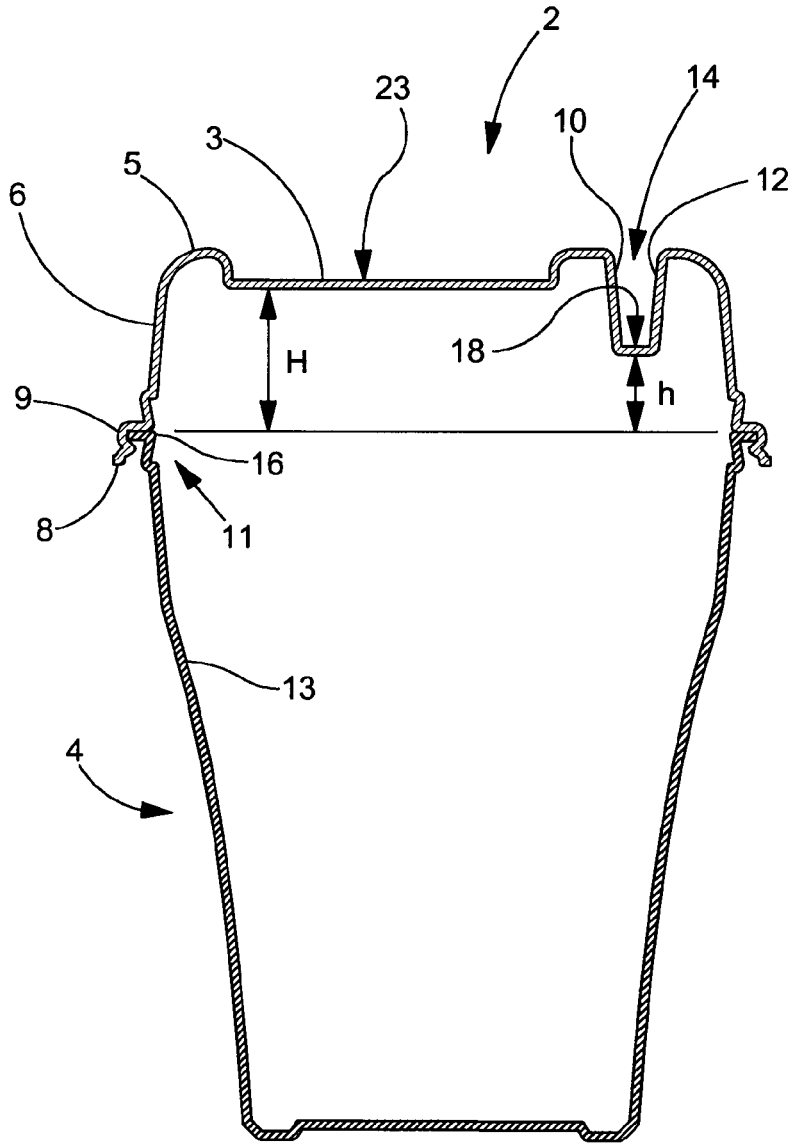
FIG. 2 is a cross-sectional view of the assembled container system in FIG. 1.
Figure 3:
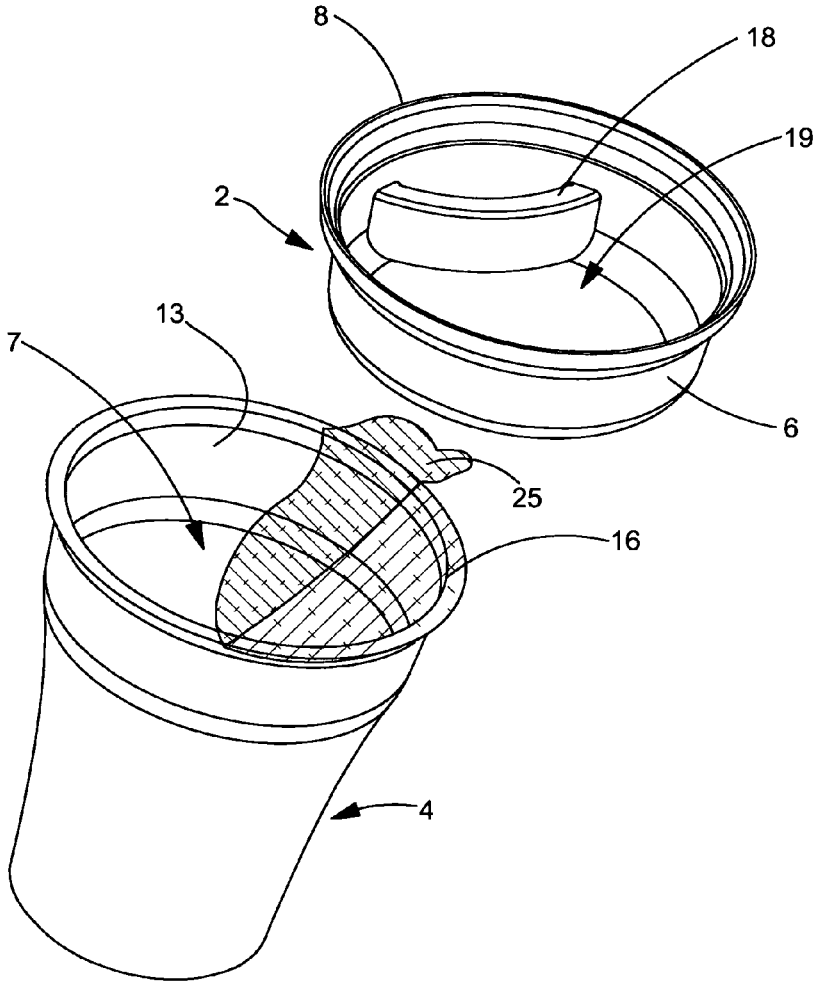
FIG. 3 is an isometric view of the container system in FIG. 1 but with the smaller second tray member inverted.
Figure 4:
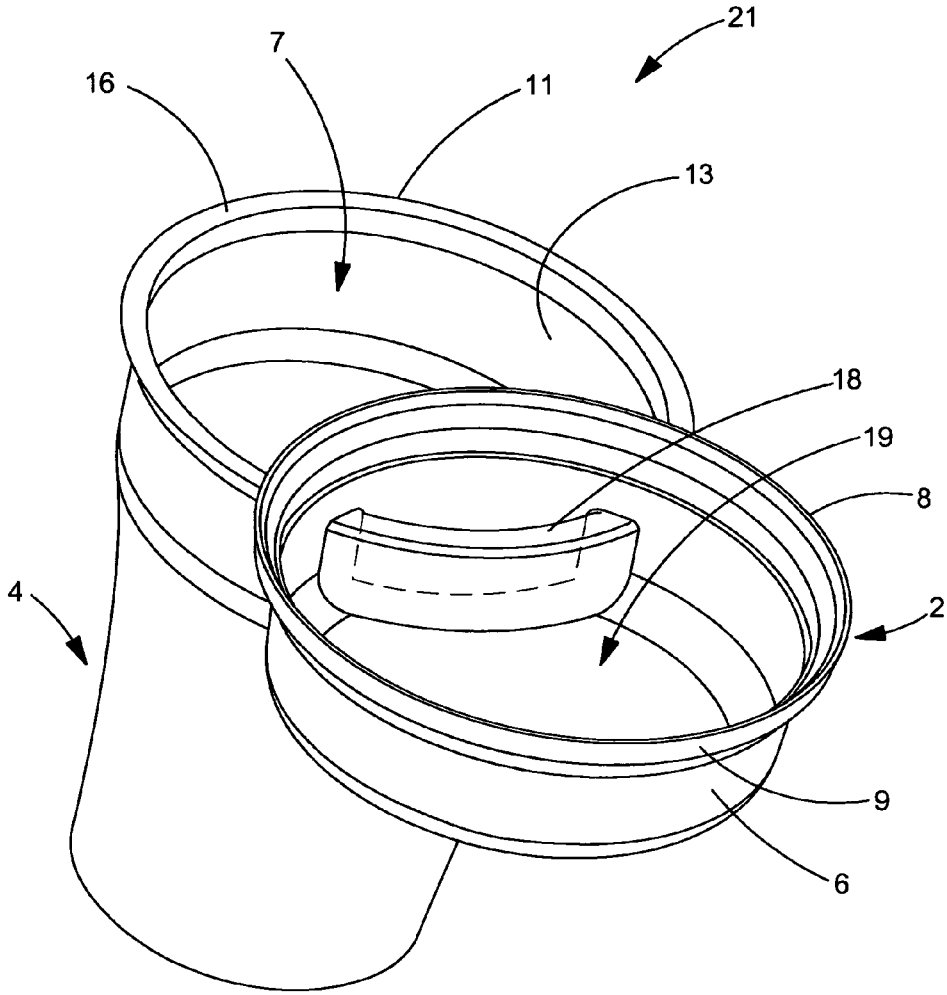
FIG. 4 is an isometric view of the container system in FIG. 3 assembled ready for use by the consumer.

Referring to the drawings and in particular to FIG. 1, there is shown a rigid polymer construct food container system 1 according to the present invention, which has a vertical axis 70. Radial directions are directions generally toward and away from the axis. The food container system 1 comprises a first tray member, or base 4 and a second smaller tray member or cover 2. The cover 2 is designed to also act as a lid member when it is inverted as shown. FIG. 1 shows the cover in a right-side-up position wherein the cover covers substantially all of the base recess 7, while FIG. 4 shows the cover in an upside-down, or inverted, position wherein the cover covers only part of the base recess. FIG. 1 shows that the cover has a top 74 and has a bottom 72 forming a rim 8 that is configured so that it mates with the base rim 16. Such attachment is achieved by the use of an annular snap-fit lock mechanism wherein the cover rim 8 is releaseably lockable to the base rim 16. The cover 2 comprises a planar surface 3 that lies above the cover rim 8 but below a cover too peripheral wall 5 that lies at the too 74 of the cover. The planar surface forms a shallow cavity 23. The cover forms a curvilinear shaped channel 14 that is configured to receive and latch to the base rim 16. The shaped channel 14 has an inner sidewall 10 and an opposing outer sidewall 12 between which the base rim 16 is inserted when the cover 2 is turned upside as in FIG. 4. This feature is exemplified in more detail in FIGS. 3 & 4. Turning first, however, to FIG. 2, therein is shown a cross-sectional view of the assembled, "ready-for-sale" container system of FIG. 1. The snap-fit lock mechanism that is used to releaseably lock the cover 2 to the base 4 is further exemplified here. Snap-fit locks have in common the principle that a protruding part of one component, e.g., a hook, stud or bead, is deflected briefly during the joining operation and is lodged in a complementary configured depression in the complementary mating component. In this instance, the snap-fit lock mechanism, as shown, is of an annular ring type wherein a continuous circumferential female cover groove 9 is formed immediately adjacent to the base rim 8 and that mates with a complementary continuous circumferential male rib 11 formed at the base 16. When the cover 2 and base 4 are assembled in this manner with foodstuff within it, the container system 1 is in a "ready-for-sale" condition. It will be appreciated that the annular ring snap-fit approach provides resistance to leakage that would not be offered by discrete or non-annular (e.g. hook, stud) type snap-fit lock mechanisms. The planar surface 3 of the cover 2 is elevated above the base rim 8 by distance H. The distance h between the floor 18 of the shaped channel 14 and the plane of the base rim 16 is preferably not greater than the distance H.

Figure 4A:
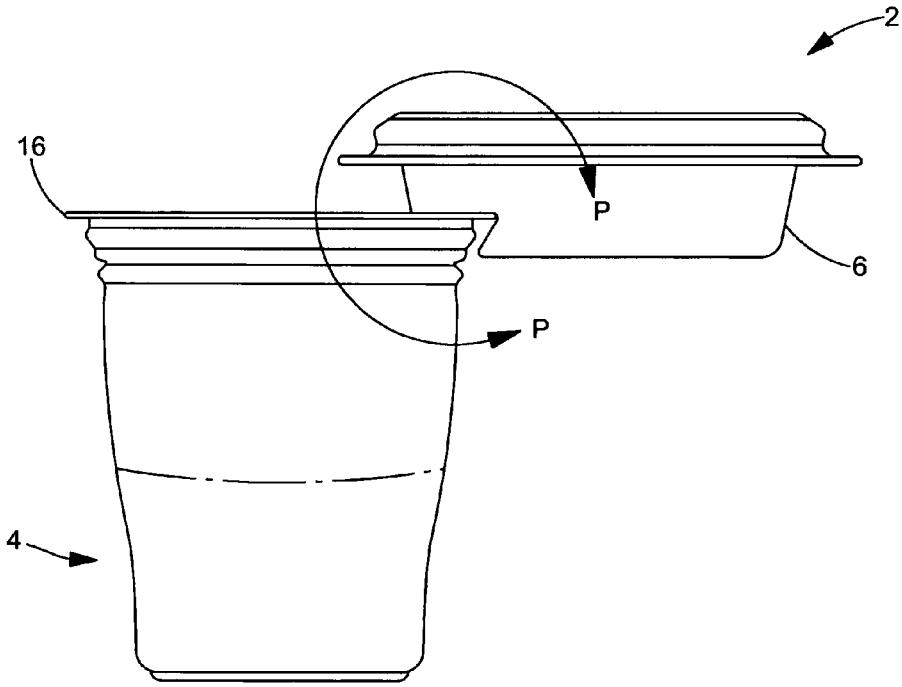
FIG. 4A is a cross-sectional view of the assembled container system in FIG. 4.
Figure 4B:
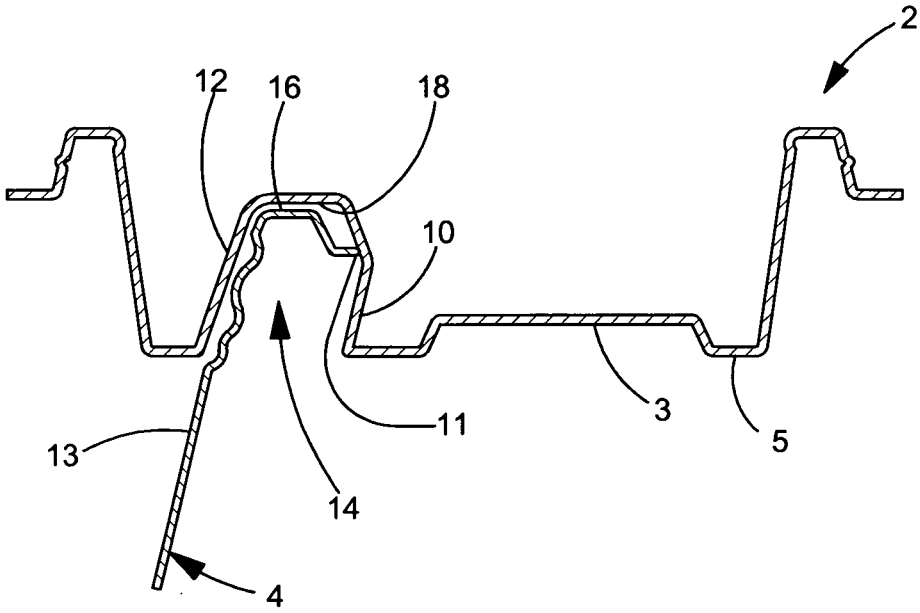
FIG. 4B is an exploded fragmentary sectional view of area P-P of the container system in FIG. 4A.

In FIG. 2 the cover is shown in its covering position wherein it covers all of the base recess. Turning now to FIG. 3, therein is shown the embodiment in FIG. 1 but with the second smaller tray member or cover 2 inverted from its covering position. The cover 2 is shown inverted to display tray recess 19 into which other foodstuff may be placed. In a covering position of FIG. 2 wherein the cover covers the recess of the base, the channel 14 opens upward, while in an upside-down or inverted position of FIG. 3 the channel opens downward. For illustrative purposes, shown is a polymer film or foil 25 that may be used to optionally retain the foodstuff within its respective base recess 7. In a similar manner, the foodstuff in the cover 2 may optionally be retained within its cover recess 19 with a film such as a foil (not shown). Turning to FIG. 4, therein is shown the container system in FIG. 3 with the inverted cover 2 attached to the base 4 to form an integrated food container system 21. Attachment of the inverted cover 2 to the base 4 is achieved by inserting any segment of the base rim 16 into the shaped channel 14 of the inverted cover 2 and causing an interference fit between the inner and outer sidewalls 10, 12 of the cover 2 and the base rim 16. FIG. 4A shows an elevation side view of the assembled container system in FIG. 4. Turning now to FIG. 4B, therein is shown an enlarged cross-sectional view of the area P-P in FIG. 4A showing the interlocking arrangement between the base rim 16 and the inverted cover 2. The inner sidewall 10 and outer sidewall 12 are formed at an angle toward each other so that, together, they enable an interference fit with the base 4 at the base wall 13 and at the base rim 16. Further, as shown, when inserted fully, the shaped channel floor 18 preferably sits on the base rim 16 so that the planes of the mouths of the cover 2 and the base 4 approximately coincide. The consumer has then a number of options including placing the lower portion of the base 4 into, say, an automobile center consol cup-holder or holding the base 4 with one hand while using their free hand to access the foodstuff in both the base and cover recesses. For example, sliced carrots may be placed into the base recess 7 and a salad dressing placed into the cover recess 19.

Figure 5:
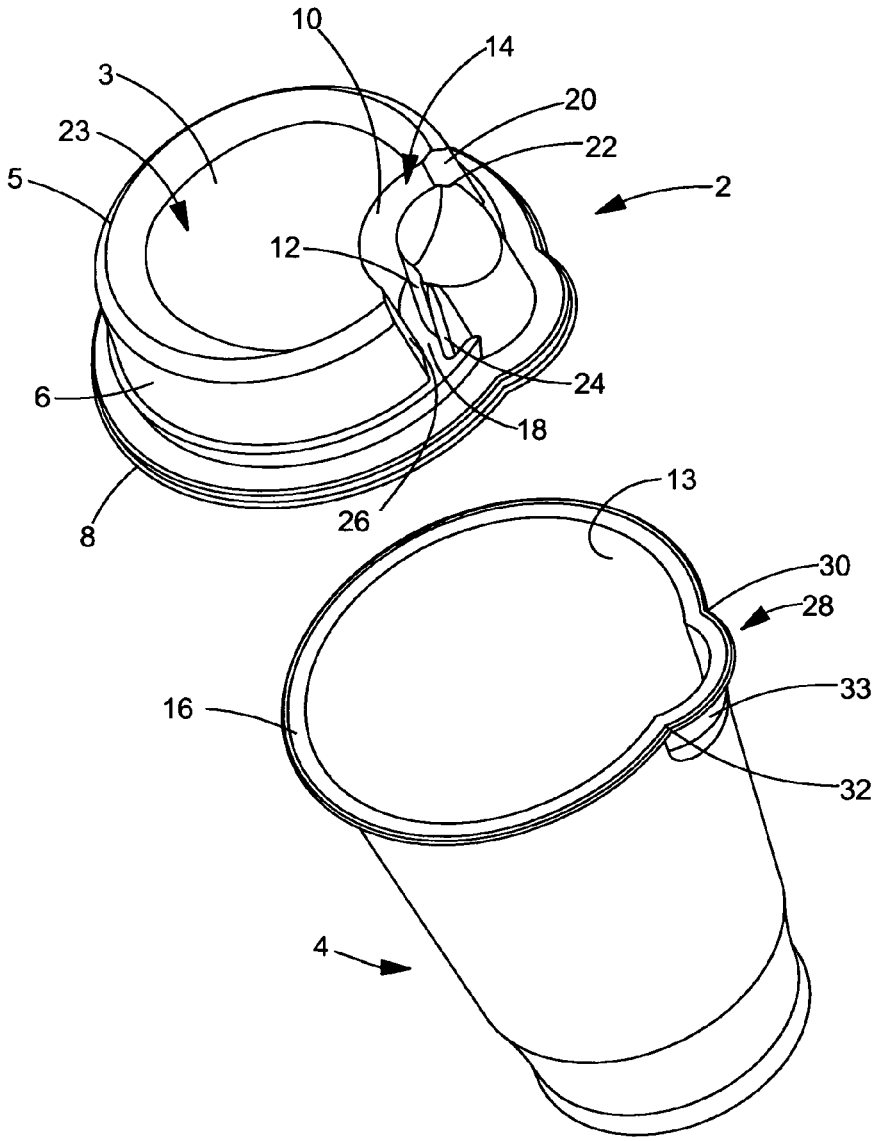
FIG. 5 is an isometric view of another embodiment of the present invention showing the disassembled smaller second tray member and tray member.
Figure 6:
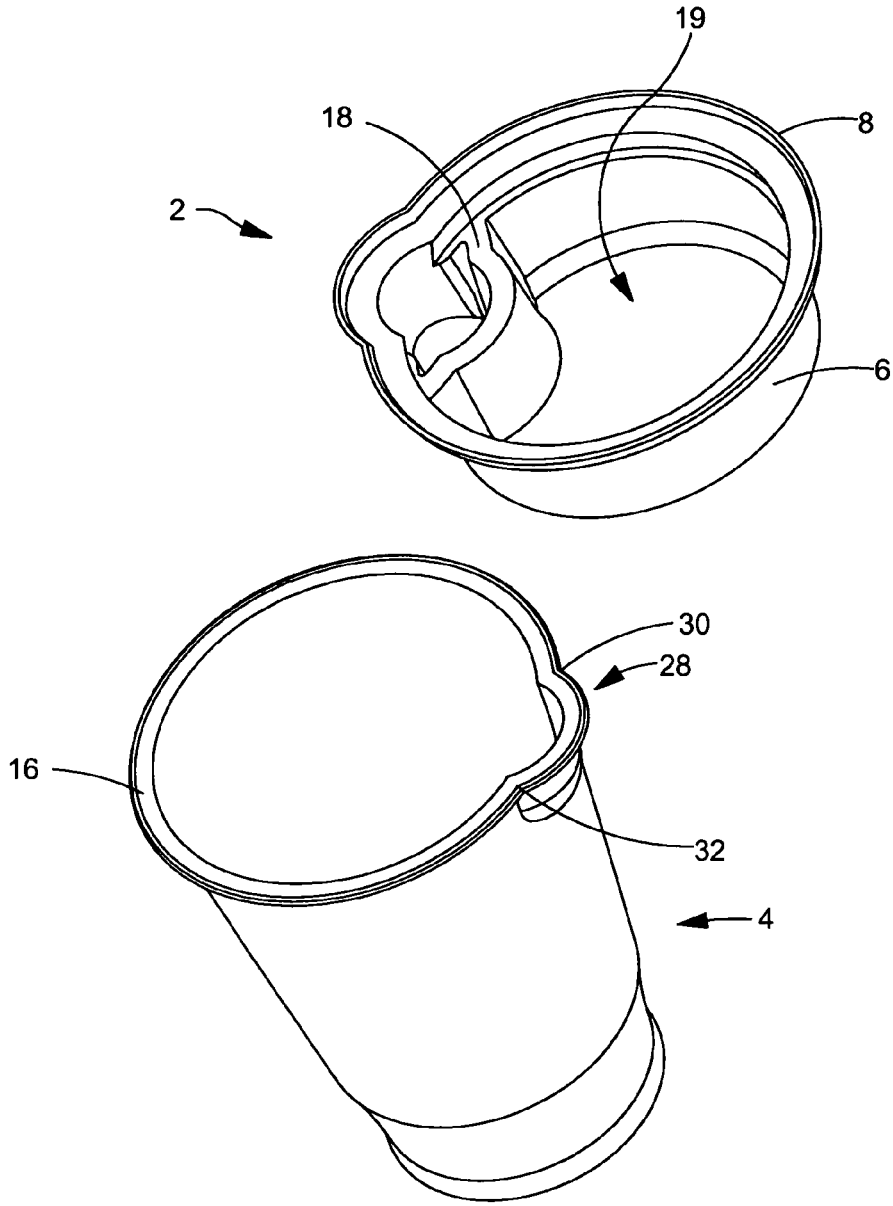
FIG. 6 is an isometric view the container system in FIG. 5 but with the smaller second tray member inverted.
Figure 7:
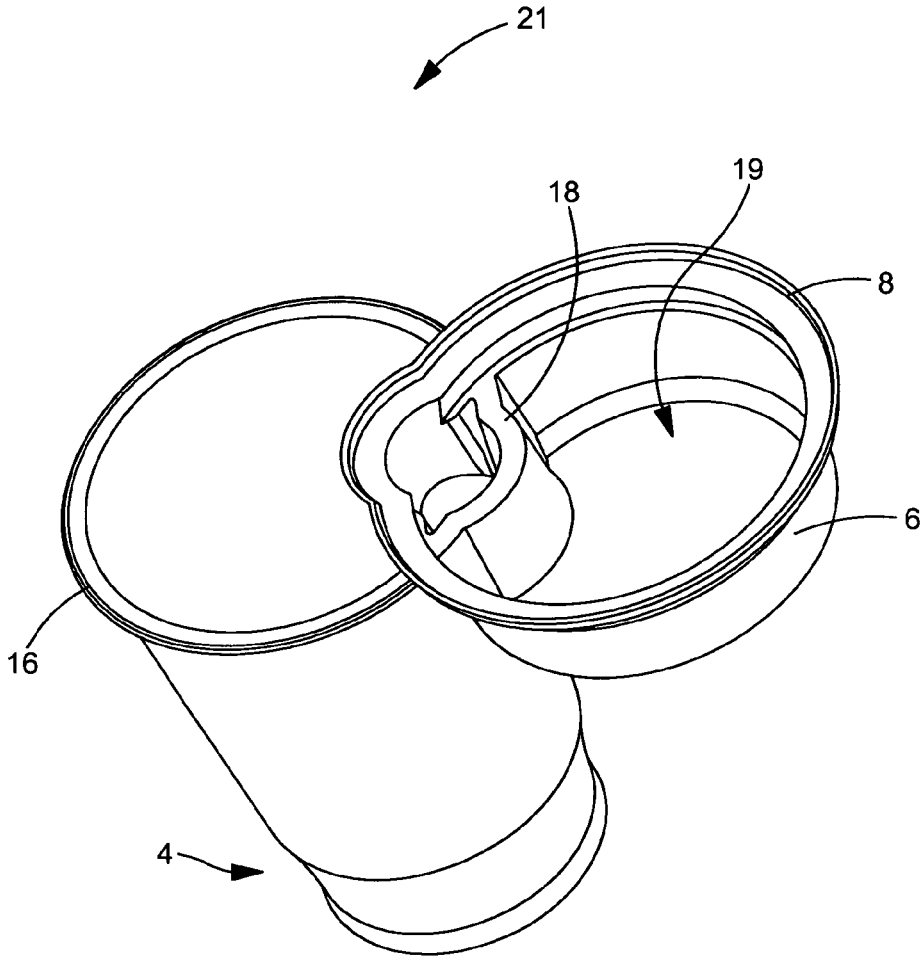
FIG. 7 is an isometric view of the container system in FIG. 6 assembled ready for use by the consumer.

Turning now to FIGS. 5, 6 and 7, therein are shown renditions of another embodiment of the present invention. In these renditions, when the cover 2 is inverted, the curvilinear configuration of the shaped channel 14 is such that it will mate with the base rim 16 only at the complementary curvilinear extended base rim segment 28 of the first tray member rim 16 as only here is the radius of the shaped channel 14 similar to that of the curvilinear extended base rim segment 28. Additionally, the shaped channel inner sidewalls 10, 26 & 20 and opposing outer sidewalls 12, 24 & 22 are formed at an angle toward each other so that, together, they make a mechanical attachment with the base rim 16 when said curvilinear extended rim segment 28 is inserted into the shaped channel 14 in a similar manner as exemplified in FIG. 4B. In this embodiment, the cross-sectional area of the mouth of the tray member defined by the base rim 16 is less restricted as compared with the embodiment of the invention depicted in FIG. 1.

Figure 9:
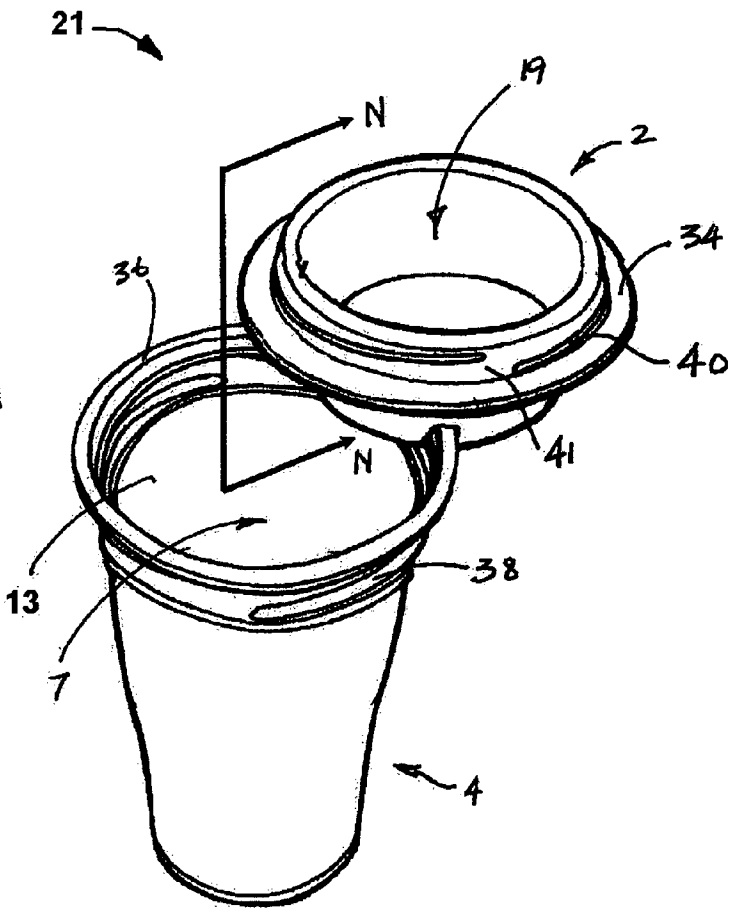
FIG. 9 is an isometric view of the container system in FIG. 8 showing the smaller second tray member assembled to the first tray member.
Figure 8:
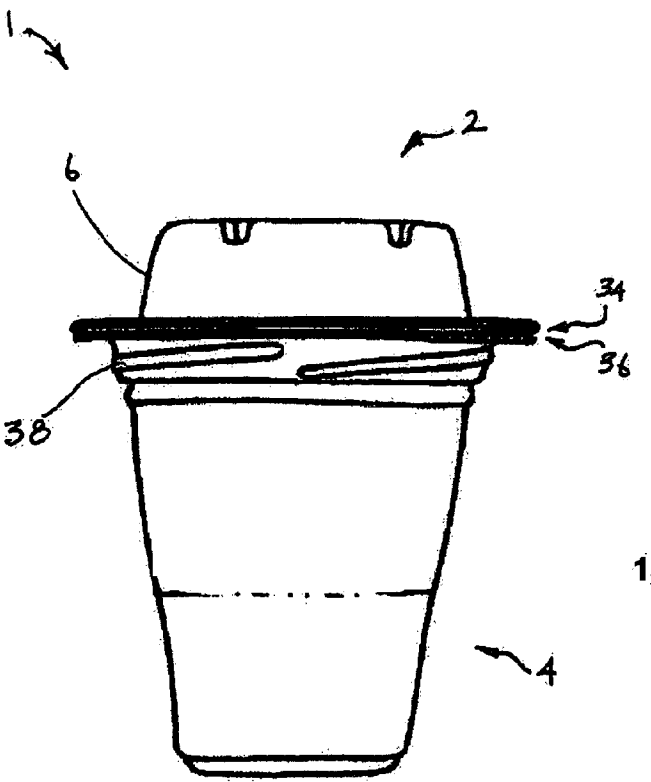
FIG. 8 is an elevation side view of another embodiment of the present invention.

Turning to FIGS. 8 & 9, therein are illustrations of a preferred embodiment of the invention wherein the cover 2 and base 4 are secured to each other using screw thread connections to achieve a "ready-for-sale" condition.

Figure 10:
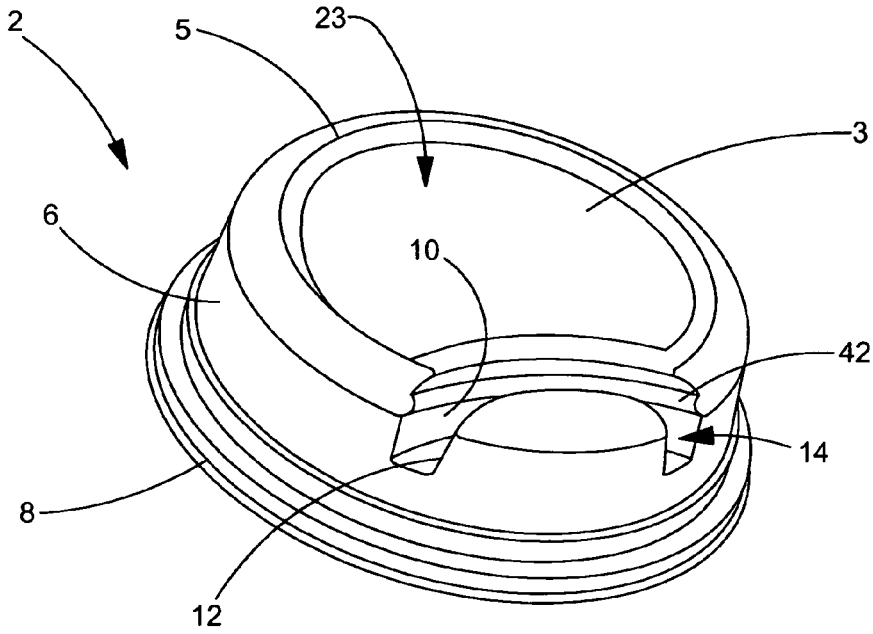
FIG. 10 is an isometric view of the smaller second tray member of the container system in FIG. 8.
Figure 11:
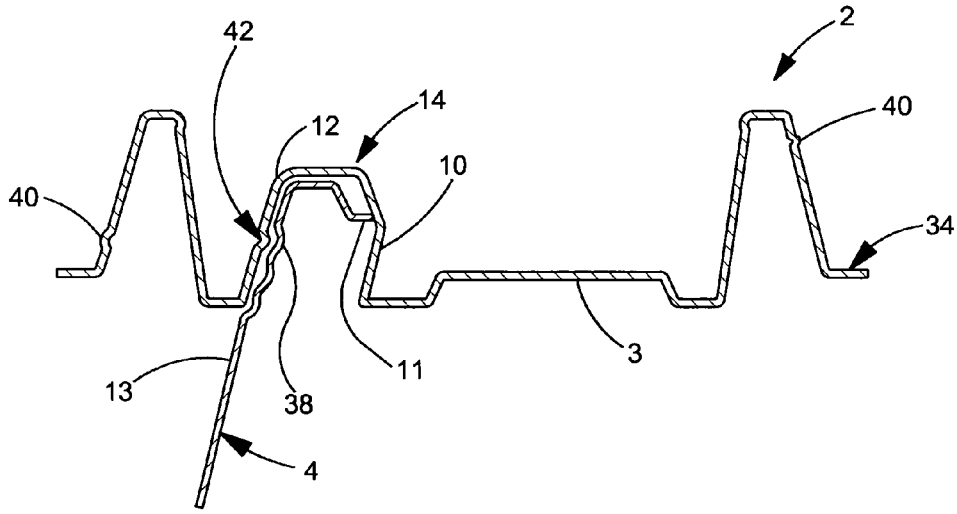
FIG. 11 is a fragmentary sectional view of the container system in FIG. 8 taken along the line N-N in FIG. 9.
Figure 13:
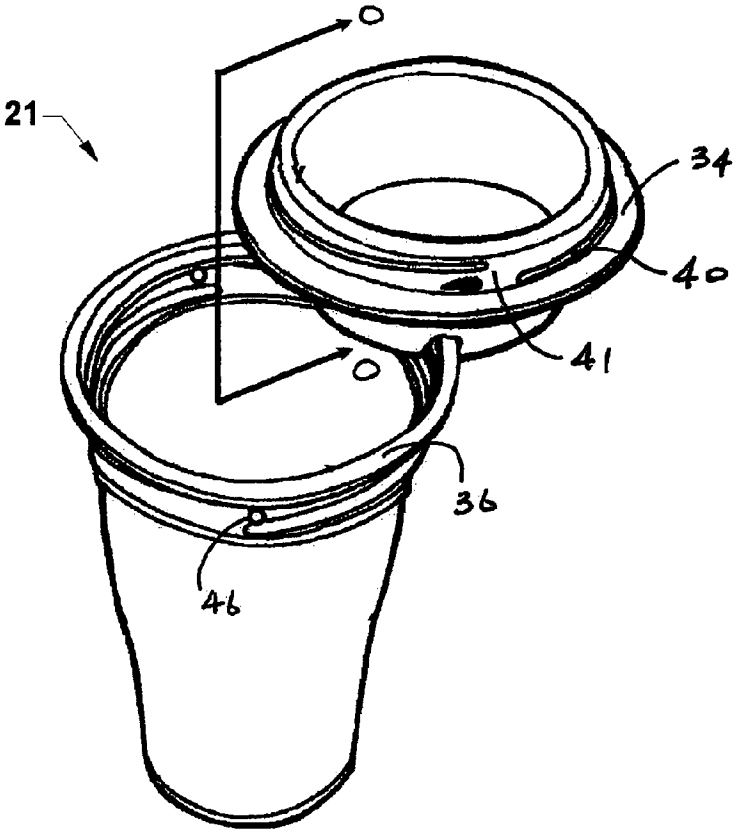
FIG. 13 is an isometric view of the container system in FIG. 12 showing the smaller second tray member inverted and assembled to the first tray member.
Figure 12:
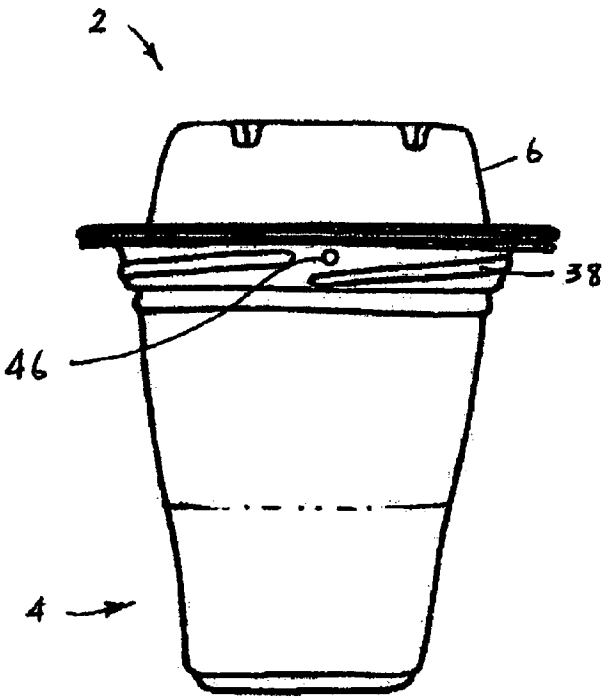
FIG. 12 is an elevation side view of another embodiment of the present invention.
Figure 14:
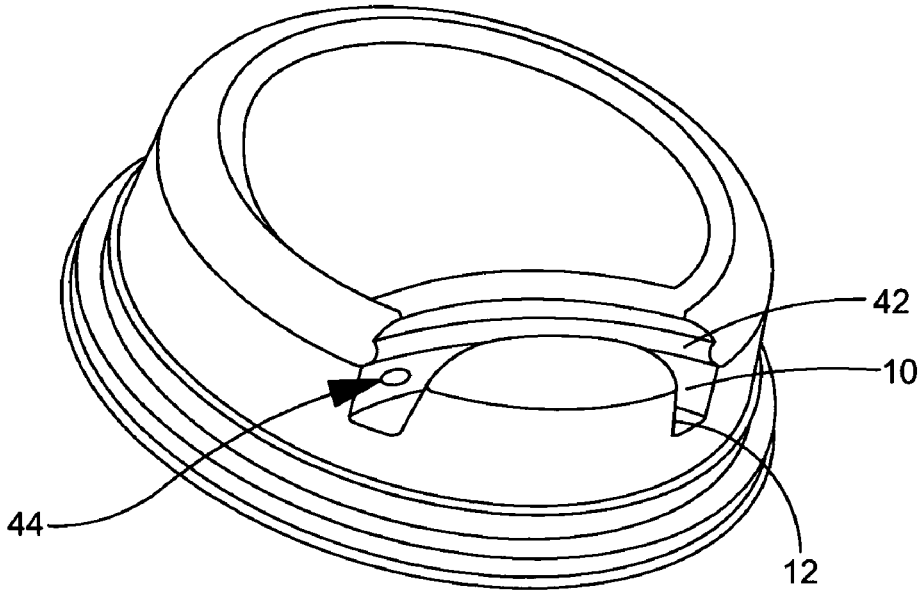
FIG. 14 is an isometric view of the smaller second tray member of the container system in FIG. 12.
Figure 15:
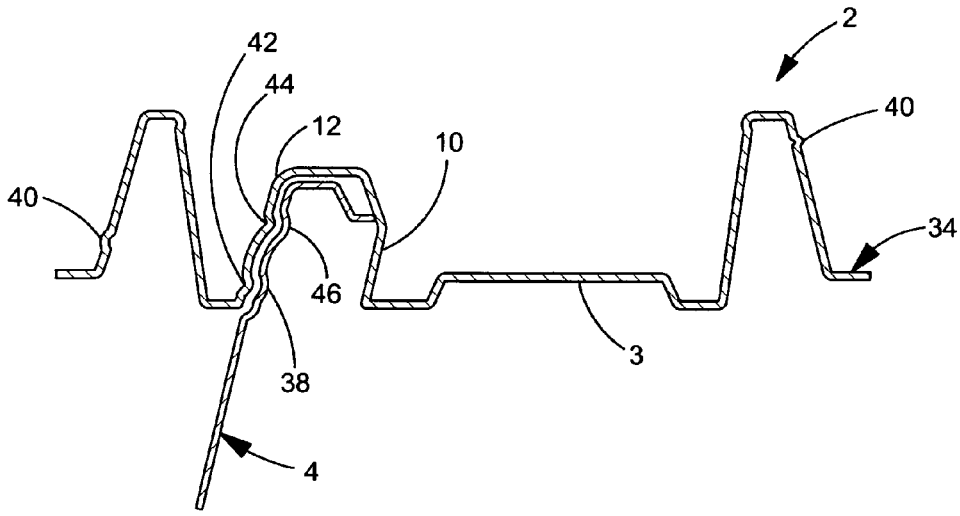
FIG. 15 is a fragmentary sectional view of the container system in FIG. 13 taken along the line O-O.
Figure 16:
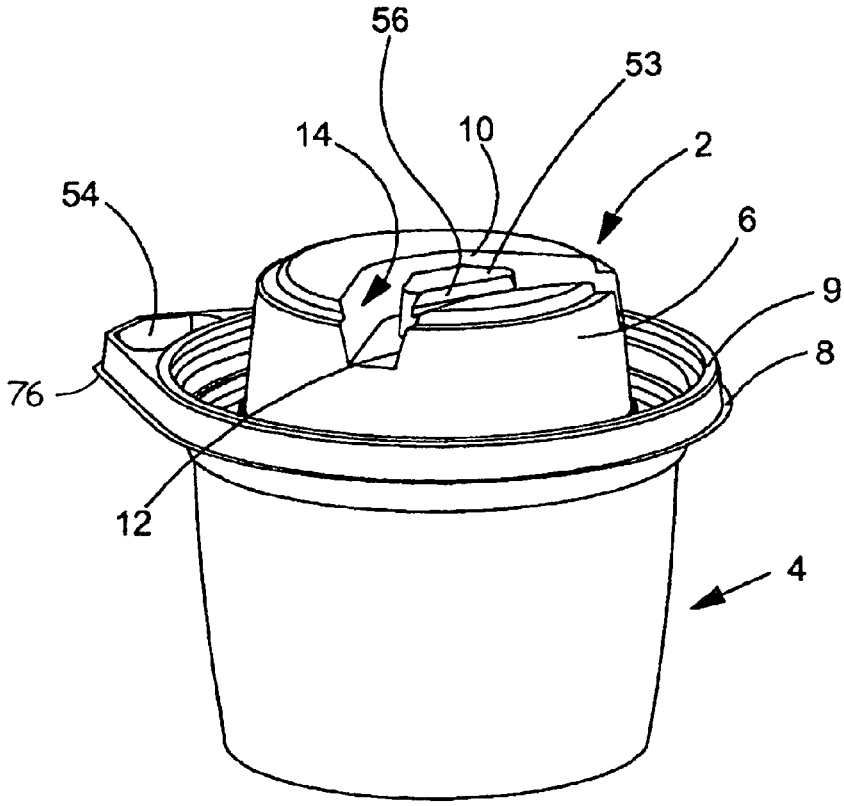
FIG. 16 is an isometric view of another embodiment of the present invention.

FIG. 9 shows the cover 2 inverted and attached to the first tray member 4 to form an integrated food container system 21, and as illustrated, the male helical thread 40 in the cover 2 is formed on the tapered surface 41, and designed to engage a similarly configured but complementary helical female thread 38 formed on the inner wall 13. When engaged in this manner, the faying surfaces 34, 36 of the cover and base 2, 4 respectively, in concert with the threaded connections, makes leak-resistant the container system. Turning to FIG. 10, therein is illustrated an isometric view of the cover 2 of the embodiment in FIGS. 8 & 9. As shown, a discrete male rib thread 42 is formed on the outer sidewall 12, and that is used to secure the inverted cover 2 to the base rim 16. The manner of engagement of the inverted cover 2 is further exemplified in FIG. 11 which is a cross-sectional view of the container system 1 in FIG. 9 taken along the line N-N. Attaching the inverted cover 2 to the base 4 is achieved by placing the base rim 16 into the shaped channel 14 and then sliding said shaped channel 14 along the base rim so that the discrete male rib thread 42 slides along the female groove thread 38 of the base 4; and the opposing resistance caused by the force between the inner sidewall 10 and the base rim 16 results in an interference fit that firmly holds the inverted cover 2 and base 4 together.

Turning now to FIGS. 12, 13, 14 & 15, therein is shown renditions of another embodiment of the invention. This embodiment possesses all the features of the embodiment depicted in FIGS. 8, 9,10 & 11, except that securing the cover 2 to the base 4 is further facilitated by a discrete male protuberance 44. Commonly referred to as a stud snap-fit lock, securing the cover 2 to the base is achieved by sliding the shaped channel 14 along the base rim 16 as previously described and exemplified in FIGS. 8, 9,10 & 11, and by further ensuring that the discrete male protuberance 44 in the cover 2 "snaps" into the complementary female depression 46 of the base 4.

Figure 17:
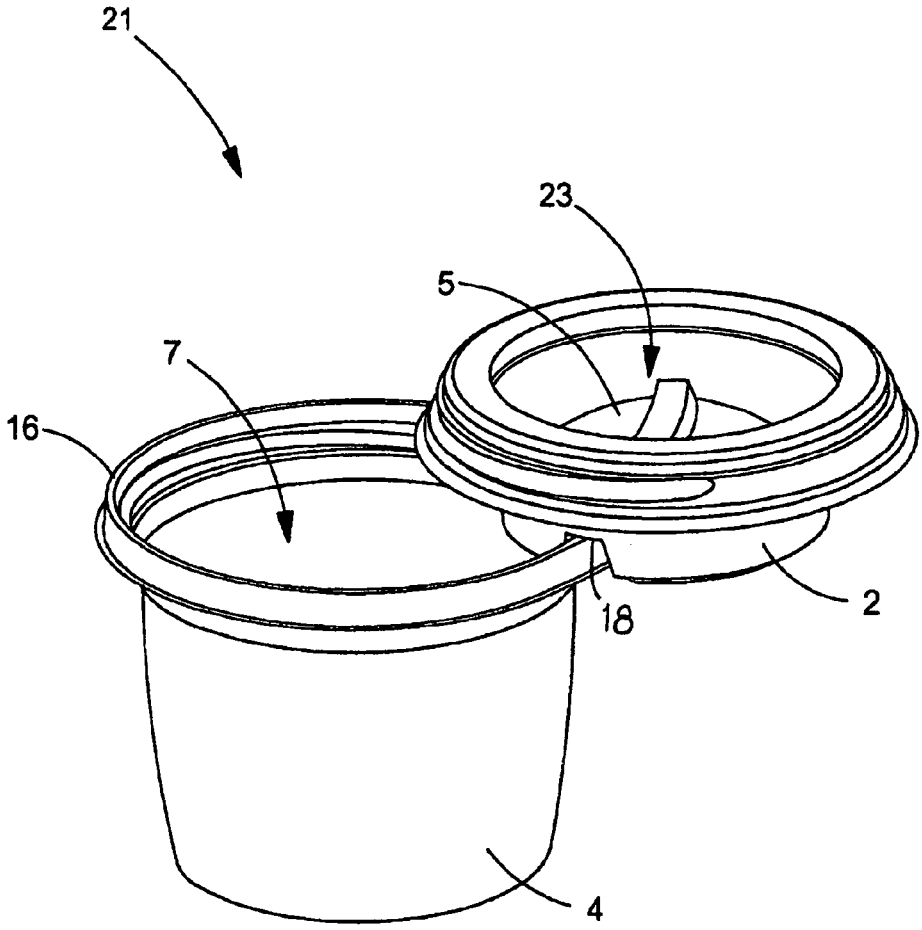
FIG. 17 is an isometric view of the container system in Figure showing the smaller second tray member inverted and assembled to the first tray member.
Figure 18:
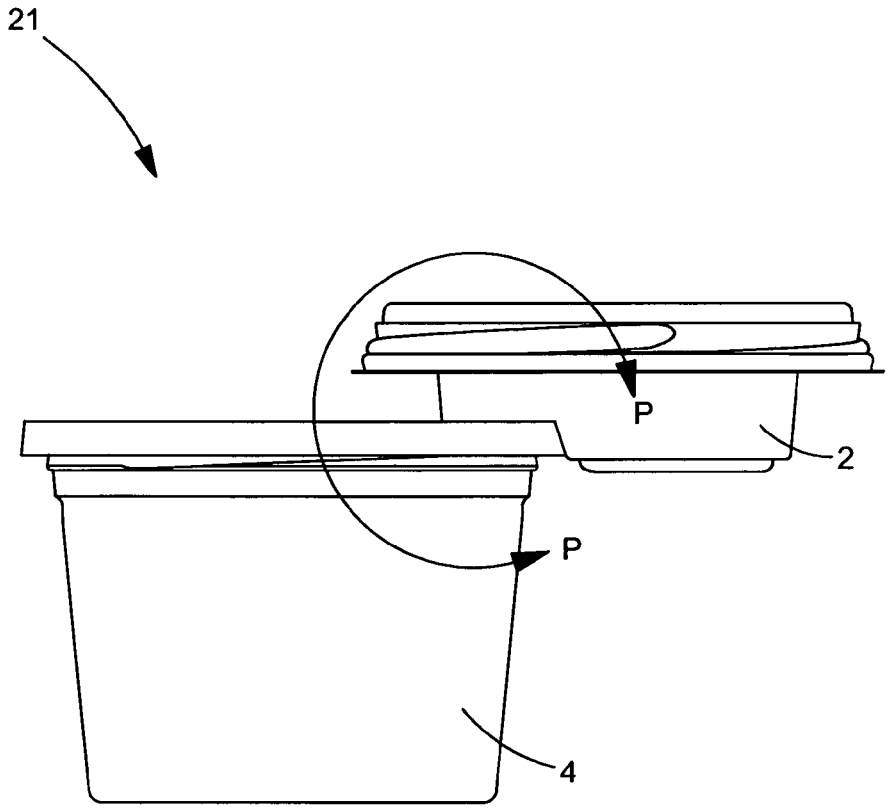
FIG. 18 is an elevation view of the container system in FIG. 17.
Figure 19:
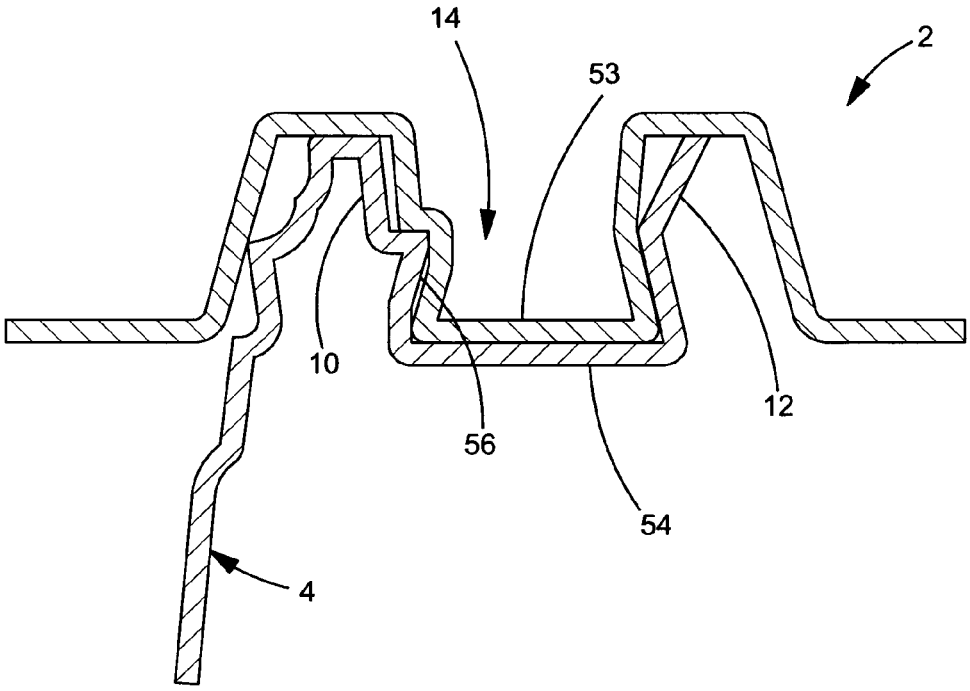
FIG. 19 is a fragmentary sectional view of the container system in FIG. 18 taken along the line P-P.

Turning to FIGS. 16, 17, 18 & 19, therein are shown another rigid polymer construct embodiment of a further enhancement of the previously described embodiment of the present invention, the enhancement being the formation of a male protuberance 53 that is formed into the floor of the shaped channel 14. A complementary female slot 54 is formed in a radially (with respect to the axis) outward extension 76, with slot 54 formed to accept the male protuberance 53. The coupling of the two tray members is further enhanced by the use of a snap-fit grip mechanical means. The snap fit grip means is formed by the undercut of slot, or recess, 54 and of protuberance or projection 53 shown in FIG. 19 which holds the cover protuberance in the slot. In these illustrations, shown formed into the male protuberance 53 is a discrete rib edge 56 that mechanically engages a corresponding complementary ledge 58 in the female slot 54 to help secure the cover 2 to the base 4. FIG. 17 shows that when the inverted cover 2 is mounted on the base 4, the channel floor 18 is supported on the base rim 16.

Figure 20:
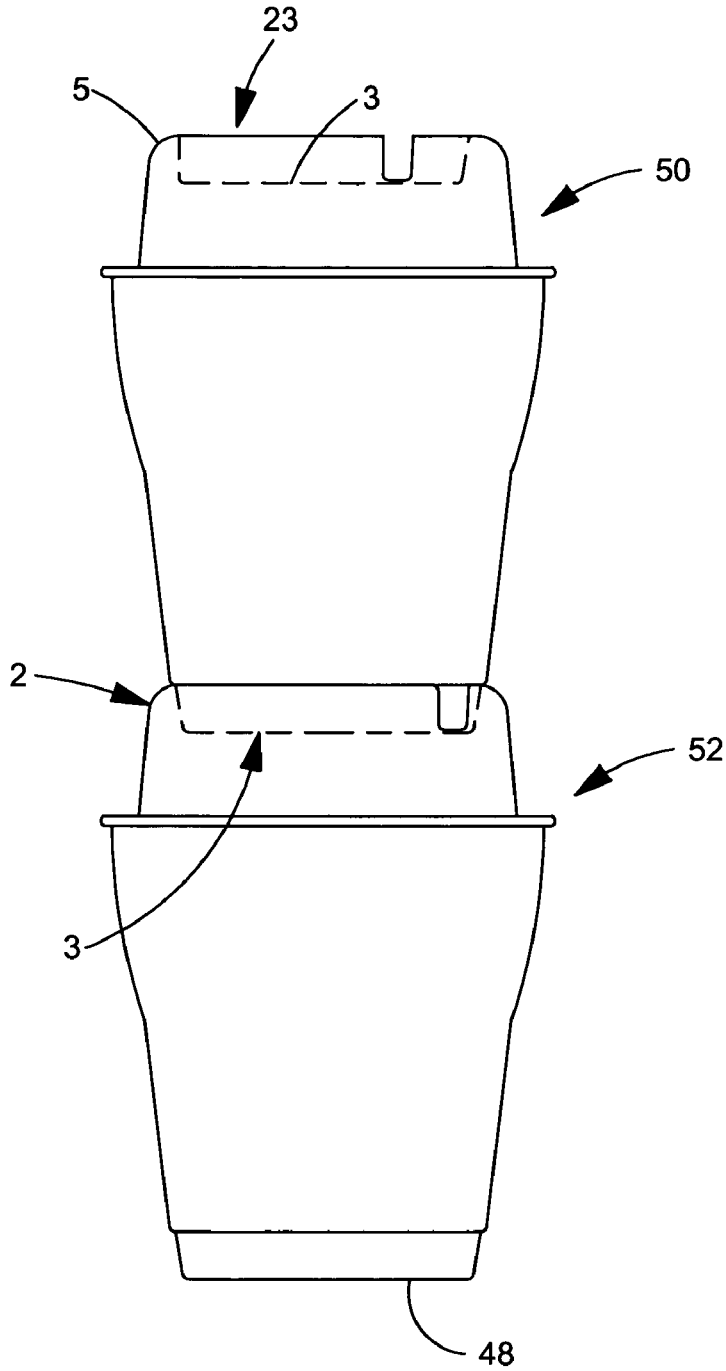
FIG. 20 is an elevation side view of one container system of the container systems in FIG. 16 stacked upon another identical container system.

Turning to FIG. 20, therein is shown a first container system 50 stacked upon a second container system 52 of the present invention. The dimensions and configuration of the bottom 48 of the base 4 are such that it permits a close fit with cavity 23 formed in the top of the lid member 2. The stacking feature of the container system to facilitate transportation, as well as display at the market.

Figure 21:
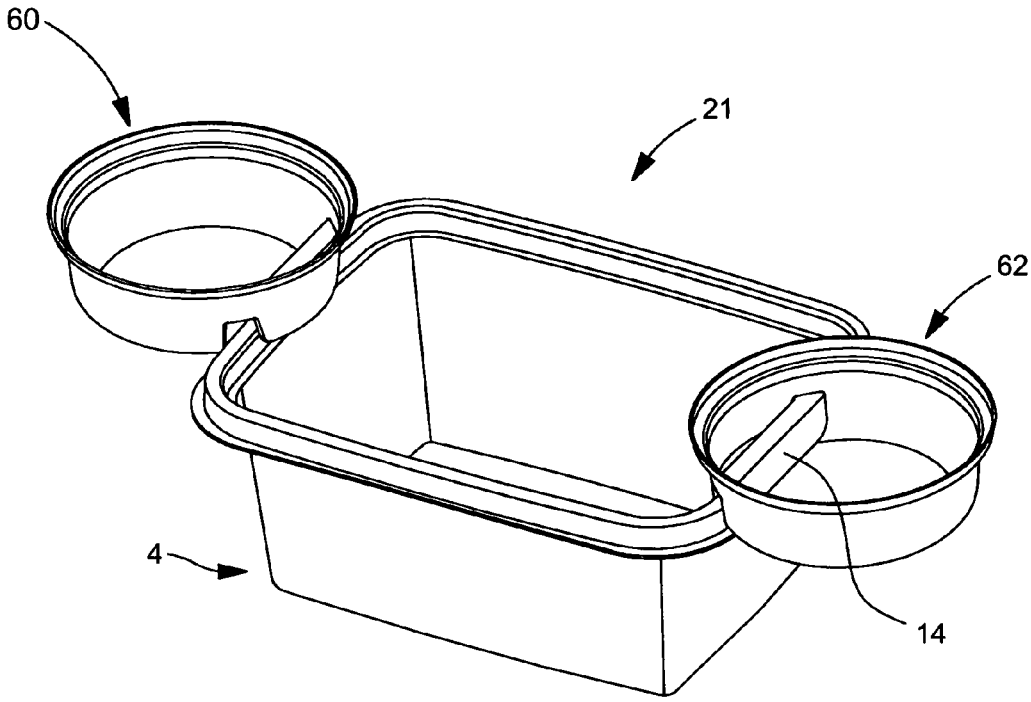
FIG. 21 is an isometric view of another embodiment of the present invention.

FIG. 21 shows a different embodiment of the present invention that does not utilize the smaller second tray members to act as a lid that mates with the mouth of the first tray member. As shown, there is illustrated a first tray member 4 to which is attached two smaller tray members 60, 62. The manner of attachment of the smaller tray members 60, 62 to the first tray member 4 have previously been described.

Although particular embodiments of the invention have been described in detail for purposes of illustration, various modifications and enhancements may be made without departing from the spirit and scope of the invention. Accordingly, the invention is not to be limited except as by the appended claims.

I claim:

1. A container with a vertical axis (70), that includes a base (4) which forms an upwardly opening base recess (7) and which has an upper end forming a base rim (16), and that includes a cover (2) with a top (74) and bottom (72), wherein said bottom is constructed to lie lowermost and lie over all of said base recess in a right-side-up position of the cover, wherein;

said cover having a channel (14) in its top, said channel opening upwardly when said cover is right-side-up, and said channel opening downwardly when said cover is turned upside-down to an inverted position wherein said cover top is lowermost, with said cover leaving much of said base recess uncovered in said inverted position;

said channel being constructed to closely receive said base rim in said inverted position of the cover;

said base has a radially outward extension (76, FIG. 16), said cover and extension being formed with one having walls forming a vertically open recess (54) with an undercut (56) and the other having a vertically projecting protuberance (53) with an undercut, with said protuberance projecting into said recess (54) when the cover is in said inverted position and said base rim lies in said channel, to snap and therefore hold said cover protuberance in said recess.

2. A container which has a vertical axis (70), comprising:

a base (4) which forms an upwardly opening base recess (7) and which has an upper end forming a base rim (16);

a cover (2) which has a top (74) and a bottom (72), with said bottom constructed to lie lowermost and attach to said base, in a right-side-up position of the cover, and with said cover covering all of said base recess in said right-side-up position;

said cover having a channel (14) in its top, said channel opening upwardly when said cover is right-side-up, and said channel opening downwardly when said cover is turned upside-down to an inverted position wherein said cover top is lowermost, with said cover leaving much of said base recess uncovered in said inverted position;

said channel being constructed to closely receive said base rim in said inverted position of the cover;

said base rim (16) has a circular portion extending around a majority of said axis and said base has a radially outward extension (76, FIG. 16), said cover and extension being formed with one having a vertically open recess (54) and the other having a vertically projecting projection (53) that project into said recess (54) when the cover is in said inverted position and said base rim lies in said channel.

3. A container which has a vertical axis (70), comprising:

a base (4) which forms an upwardly opening base recess (7) and which has an upper end forming a base rim (16);

a cover (2) which has a top (74) and a bottom (72), with said bottom constructed to lie lowermost and attach to said base, in a right-side-up position of the cover, and with said cover covering all of said base recess in said right-side-up position;

said cover having a channel (14) in its top, said channel opening upwardly when said cover is right-side-up, and said channel opening downwardly when said cover is turned upside-down to an inverted position wherein said cover top is lowermost, with said cover leaving much of said base recess uncovered in said inverted position;

said channel being constructed to closely receive said base rim in said inverted position of the cover;

said base rim has a radially outward extension (76, FIG. 16) that forms an upwardly open slot (54);

said channel (14) has inner and outer channel side walls (10, 12) and has a vertical projection (53) lying between said channel side walls;

when said cover is in said inverted position said projection (53) projects downwardly into said slot (54).

4. A container which has a vertical axis (70), comprising:

a base (4) which forms an upwardly opening base recess (7) and which has an upper end forming a base rim (16);

a cover (2) which has a top (74) and a bottom (72), with said bottom constructed to lie lowermost and attach to said base, in a right-side-up position of the cover, and with said cover having a cover periphery (6) and said cover covering all of said base recess in said right-side-up position;

said cover having a channel (14) in its top said channel extending between a pair of locations spaced around said cover periphery, said channel opening upwardly when said cover is right-side-up, and said channel opening downwardly when said cover is turned upside-down to an inverted position wherein said cover top is lowermost, with said cover leaving much of said base recess uncovered in said inverted position;

said channel being constructed to closely receive said base rim in said inverted position of the cover;

said channel (14) has a channel floor (18) that lies between said cover top and bottom in both the right-side-up and upside down, or inverted, position of the cover and said channel floor is supported on the base rim (16) in said inverted position of the cover.

* * * * *